US006896105B1

(12) United States Patent
Yamakawa

(10) Patent No.: US 6,896,105 B1
(45) Date of Patent: May 24, 2005

(54) ELEVATOR SYSTEM INCLUDING CONTROL PANEL WITHIN HOISTWAY

(75) Inventor: Shigeki Yamakawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/889,665

(22) PCT Filed: Jan. 17, 2000

(86) PCT No.: PCT/JP00/00158

§ 371 (c)(1),
(2), (4) Date: Jul. 19, 2001

(87) PCT Pub. No.: WO01/53184

PCT Pub. Date: Jul. 26, 2001

(51) Int. Cl.[7] ..... B66B 11/02; B66B 11/08; B66B 7/00

(52) U.S. Cl. ..... 187/254; 187/264; 187/414

(58) Field of Search ..... 187/250, 251, 187/254, 264, 319, 401, 414

(56) References Cited

U.S. PATENT DOCUMENTS

| | | | | |
|---|---|---|---|---|
| 4,438,831 A | * | 3/1984 | Rohanna | 187/276 |
| 5,469,937 A | * | 11/1995 | Hakala et al. | 187/266 |
| 5,490,578 A | * | 2/1996 | Aulanko et al. | 187/254 |
| 5,740,888 A | * | 4/1998 | Aulanko et al. | 187/336 |
| 5,971,109 A | * | 10/1999 | Aulanko et al. | 187/263 |
| 6,006,866 A | * | 12/1999 | Horne et al. | 187/316 |
| 6,039,152 A | | 3/2000 | Schöps et al. | |
| 6,230,845 B1 | * | 5/2001 | Yamakawa et al. | 187/314 |
| 6,230,846 B1 | * | 5/2001 | Namba et al. | 187/401 |

FOREIGN PATENT DOCUMENTS

| | | | |
|---|---|---|---|
| EP | 0 631 966 | | 9/1999 |
| EP | 1016614 A | | 7/2000 |
| EP | 1020393 A | | 7/2000 |
| JP | 4-280781 | | 10/1992 |
| JP | 631967 | * | 1/1995 |
| JP | 631968 | * | 1/1995 |
| JP | 680920 | * | 11/1995 |
| JP | 10-231074 A | | 9/1998 |
| JP | 11-60117 | | 3/1999 |
| JP | WO 99/65812 | * | 12/1999 |
| JP | 2000159453 | * | 6/2000 |

* cited by examiner

*Primary Examiner*—Eileen D. Lillis
*Assistant Examiner*—Paul T. Chin
(74) *Attorney, Agent, or Firm*—Leydig, Voit & Mayer, Ltd.

(57) ABSTRACT

An elevator system includes a hoistway including a hoistway wall and a bottom portion, the hoistway wall including a protrusion projecting from the hoistway wall inside the hoistway, a vertical moving member ascending and descending the hoistway without interfering with the protrusion, and a control panel for controlling the movement of the vertical moving member, the control panel being disposed within the hoistway and in an overlapping relationship with a projected region of the protrusion, projected in the direction of movement of the vertical moving member. The space within the hoistway is efficiently utilized and easy maintenance of the elevator system is provided.

8 Claims, 6 Drawing Sheets

ELEVATOR SYSTEM INCLUDING CONTROL PANEL WITHIN HOISTWAY

TECHNICAL FIELD

This invention relates to an elevator system and, in particular, to an elevator system having a control panel within the hoistway.

BACKGROUND ART

In a conventional elevator system, a hoist, a control panel, and the like are installed in a machine room disposed above the hoistway, so that an installation space for the machine room must be maintained at the highest portion of the building, thus decreasing the efficiency of the use of building space and increasing the height of the building.

On the other hand, an elevator system with no machine room has been proposed in which, as shown in FIGS. 5 and 6, for example, the hoist and the control panel are installed in an overlapping relationship within a gap defined between the hoistway wall and the travel region of the car, which is a moving member. In the figures, the reference number 1 is a hoistway, 2 is an elevator car, which is a member ascending and descending within the hoistway, 3 is a hoist for driving the car 2 up and down, 4 is a main rope wound on the hoist 3 for supporting the car 2, 5 is a counter weight supported on the main rope 4 at the opposite side of the car 2, 6 is a control panel for driving and controlling the hoist 3, 7 are car guide rails guiding the car 2 moving up and down, 8 are counter weight guide rails guiding the counter weight 5 moving up and down along the hoist way, 9 is a landing floor at which the passengers enter into and exit from the elevator car 2, 10 is a floor door disposed at the landing floor 9, 11 is a car door mounted to the car 2 and opened and closed in connection with the landing floor door 10, and 12 is a door mechanism for supporting the car door 11 and operating with the car door 11 suspended therefrom.

Japanese Patent Laid-open No. 7-10434 (corresponding to European Patent Application EP 0631967) discloses an elevator system in which the hoist and the control panel are mounted at the highest portion of the hoistway and the machine room is eliminated. Japanese Patent Laid-Open No. 7-10437 (corresponding to European Patent Application No. EP 0631968) discloses an elevator system in which the hoist and the control panel are installed at the bottom portion of the hoistway and the machine room is eliminated. However, in these elevator systems, even though the machine room can be eliminated, the height of the hoistway may be increased or the horizontal projection area of the hoistway may be increased.

Further, Japanese Laid-Open No. 8-40675 (corresponding to European Patent Application EP 0680920) discloses that a housing of the main portion of the drive unit including the control panel is within the depth of a concavity in the side wall of the hoistway. With this measure, however, the depth or the thickness of the drive unit housed within the concavity must be limited in the direction of the hoistway side wall thickness, resulting in difficulties in designing the drive unit. Also, with this structure, the side of the drive unit opposite the hoistway inevitably faces rooms or passages adjacent to the hoistway, making it necessary to provide a counter measure against elevator noise.

DISCLOSURE OF INVENTION

This invention has been made to solve the above-discussed problems of the conventional design and has as its object the provision of an elevator system having a reduced burden on space requirements within a building and improved efficiency in use of space without the need for an opening in the hoistway walls except for the entrance and exit of passengers and without increasing the height of the building.

BRIEF DESCRIPTION OF THE DRAWINGS

The present invention will become more readily apparent from the following detailed description of the preferred embodiments of the present invention taken in conjunction with the accompanying drawings, in which.

BEST MODE FOR CARRYING OUT THE INVENTION

The best mode of the present invention will now be described with reference to the accompanying drawings.

Figure 1:
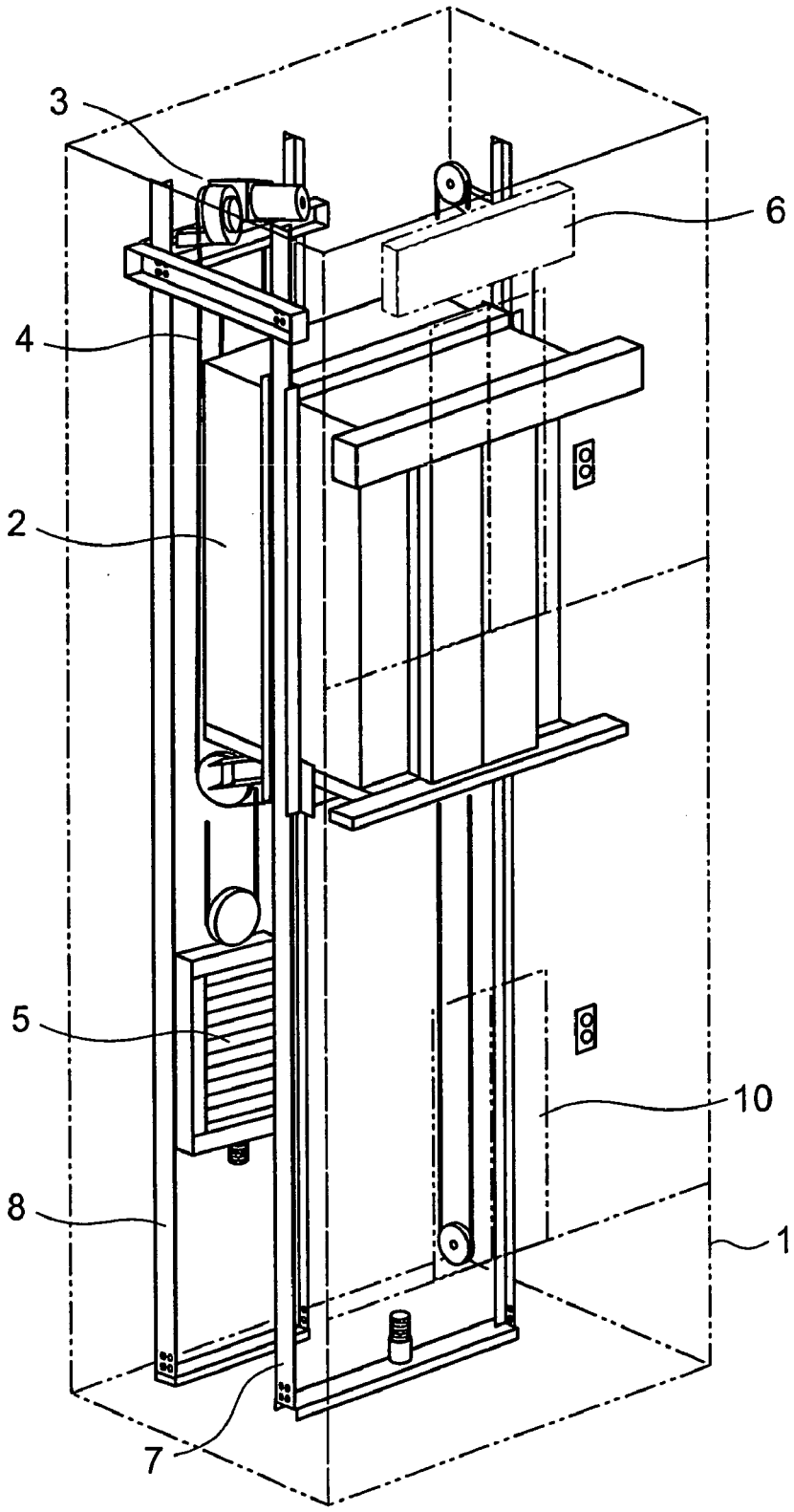
FIG. 1 is a perspective view of an elevator system relating to a second embodiment of the present invention.
Figure 2:
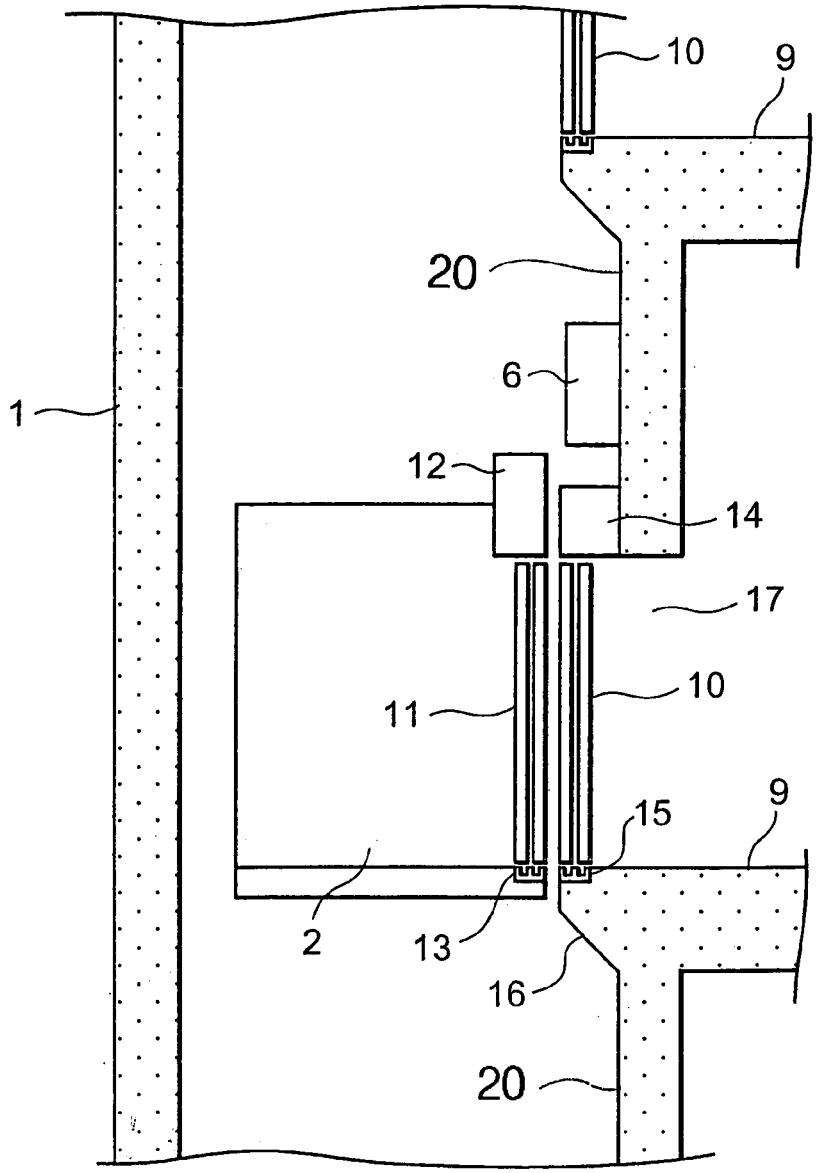
FIG. 2 is a vertical sectional view of an elevator system relating to a first embodiment of the present invention.
Figure 5:
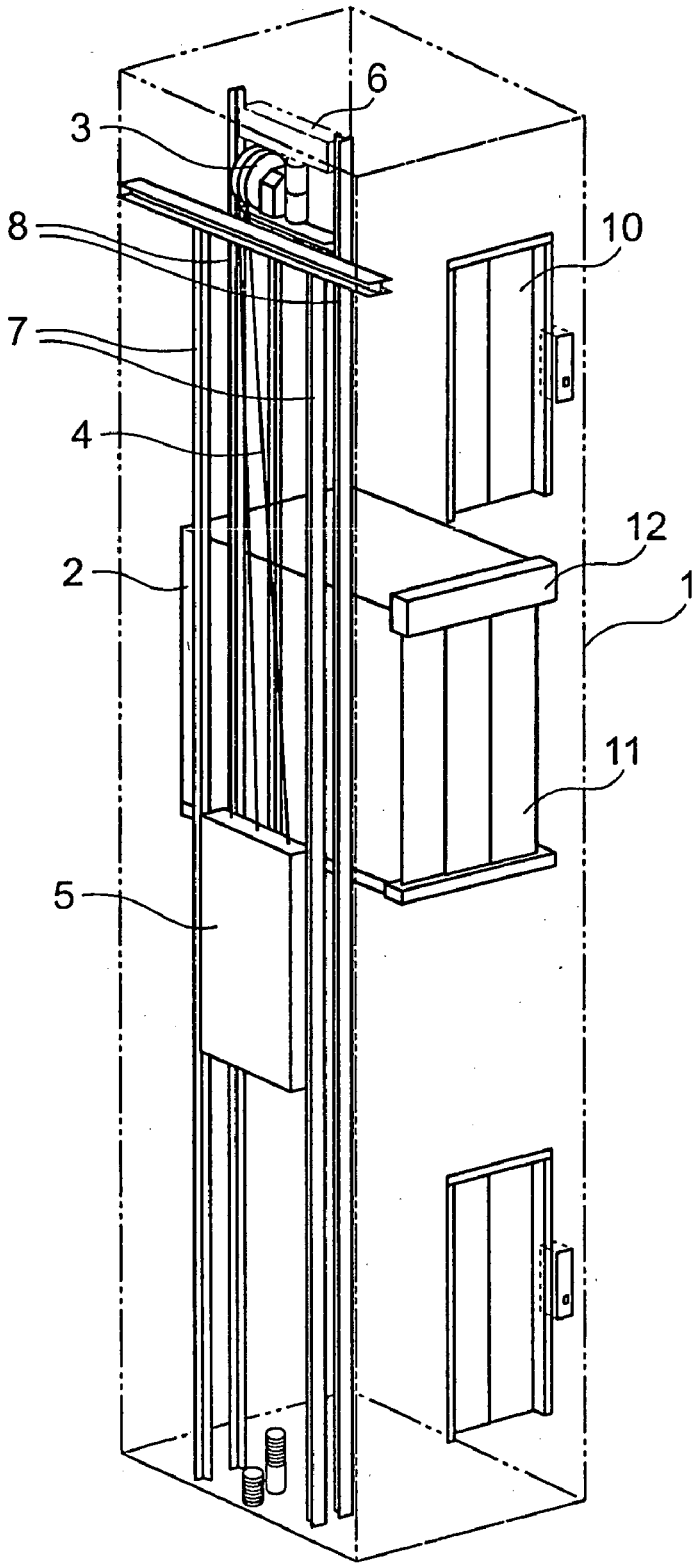
FIG. 5 PRIOR ART
FIG. 5 is a perspective view of a conventional elevator system.
Figure 6:
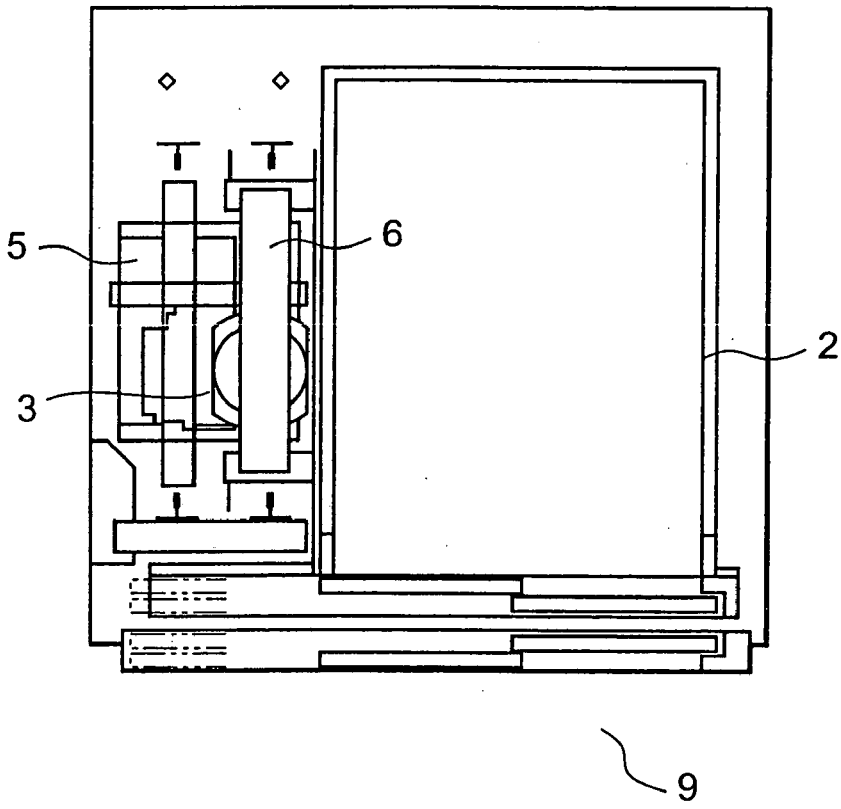
FIG. 6 PRIOR ART
FIG. 6 is a plan view of the hoistway of FIG. 5 as viewed from above the elevator hoistway.

FIG. 1 is a perspective view of an elevator system of one embodiment of the present invention and FIG. 2 is a vertical sectional view of another embodiment of an elevator system of the present invention. In the figures, the same components designated by the same reference numbers as those in FIGS. 5 and 6 in connection with the background art are identified by the same reference numbers. In the reference numbers 1 is a hoistway, 2 is an elevator car which is a member ascending and descending within the hoistway, 3 is a hoist for driving the car 2 up and down, 4 is a main rope wound on the hoist 3 for supporting the car 2, 5 is a counter weight supported on the main rope 4 at the opposite side of the car 2, 6 is a control panel for driving and controlling the hoist 3, 7 are car guide rails disposed for guiding the car 2 moving up and down, 8 are counter weight guide rails for guiding the counter weight 5 moving up and down along the hoist way, 9 is a landing floor at which the passengers enter into and exit from the elevator car 2, 10 is a floor door disposed at the landing floor 9, 11 is a car door mounted to the car 2 and opened and closed in connection with the landing floor door 10, and 12 is a door mechanism for supporting the car door 11 and operating with the car door 11 suspended therefrom. 13 is a car sill for guiding the car door 11 sliding between the open and closed positions, 14 is a landing floor door mechanism for supporting the landing floor door 10, 15 is a landing floor sill for guiding the landing floor door 10 sliding between the open and closed position, 16 is a building structural member projecting into the hoistway 1 supporting the landing floor sill 15, 17 is an opening portion provided in the hoistway 1 for providing the access to the elevator car 2, and 20 is a face of the hoistway wall.

In the elevator system with such a structure, the control panel 6 for driving and controlling the hoist 3 is installed within the hoistway 1 and within a region defined by a vertical projection onto a horizontal plane of an overhang. When the overhang is projected into the hoistway, it overlaps the landing floor mechanism 14, the landing floor sill 15, and the building structure member 16, so that it cannot interfere with the region within the hoistway in which the moving member, the car 2, moves. Also, at the landing floor opening 17, no vertically elongated members, such as the main rope, the governor rope, the guide rails, and the like are present so that they do not interfere with the control panel. The control panel installed above the entrance opening cannot interfere with the above-mentioned members so that the maintenance of the control panel is not impeded. Further, when the control panel is positioned above the opening, maintenance of the control panel above the opening can be easily carried out by moving the car to a position with personnel riding on the car top, so the personnel have access to the control panel. Then the power source is interrupted to stop the car and the landing floor door is opened from the landing floor side. The car top serves as the floor for personnel for maintenance of the control panel above the opening portion.

Figure 3:
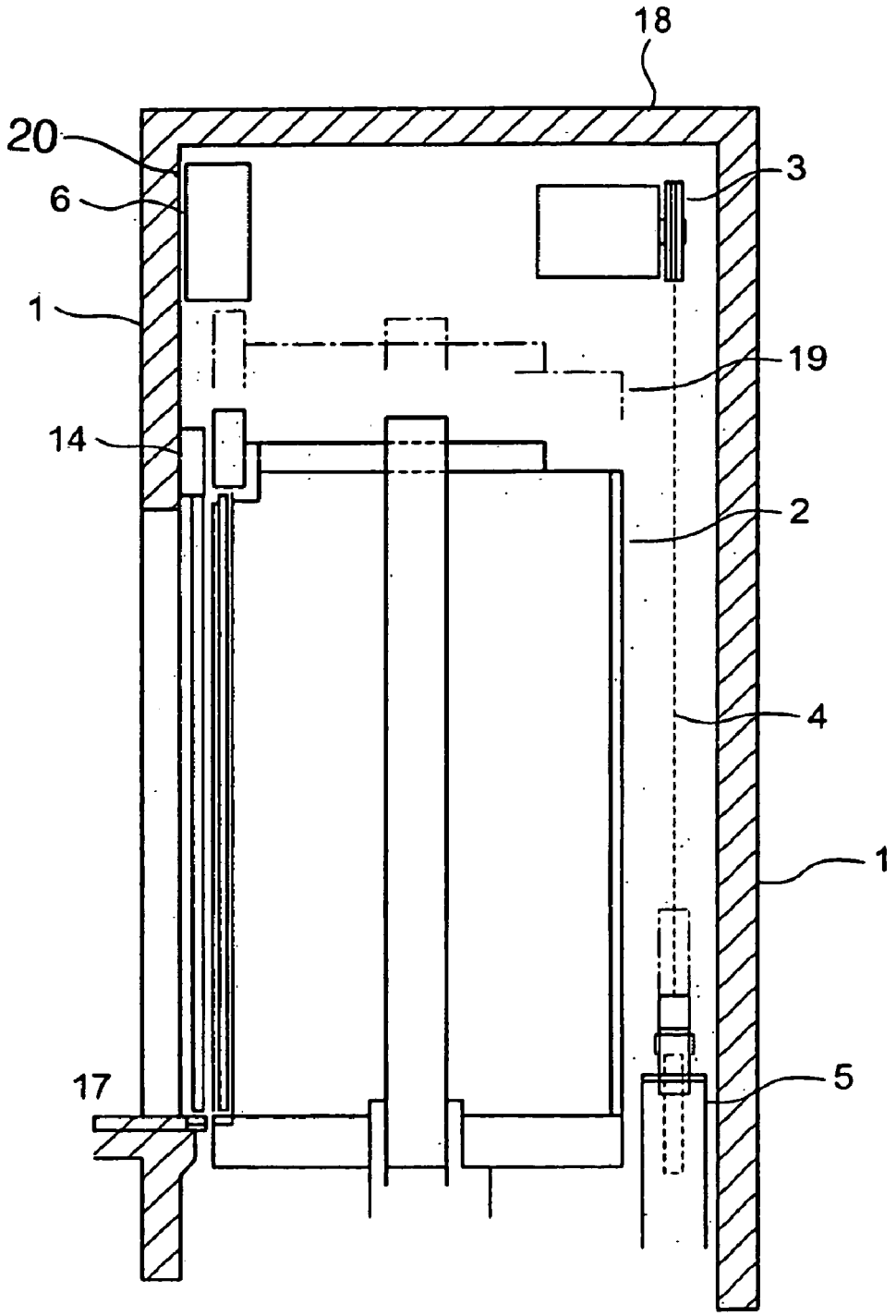
FIG. 3 is a vertical sectional view of the top portion of the hoistway of an elevator system relating to the second embodiment of the present invention.

While the control panel 6 is disposed between two floors with landings in the embodiment shown in FIG. 2, the control panel may also be disposed above the landing floor of the top-most floor as illustrated in FIGS. 1 and 3 for example. In this case, a control panel having a large horizontal thickness extending beyond the projections from the hoistway wall can be used by positioning the control panel above the travel path i.e., higher than the top end of the travel of the elevator car.

Figure 4:
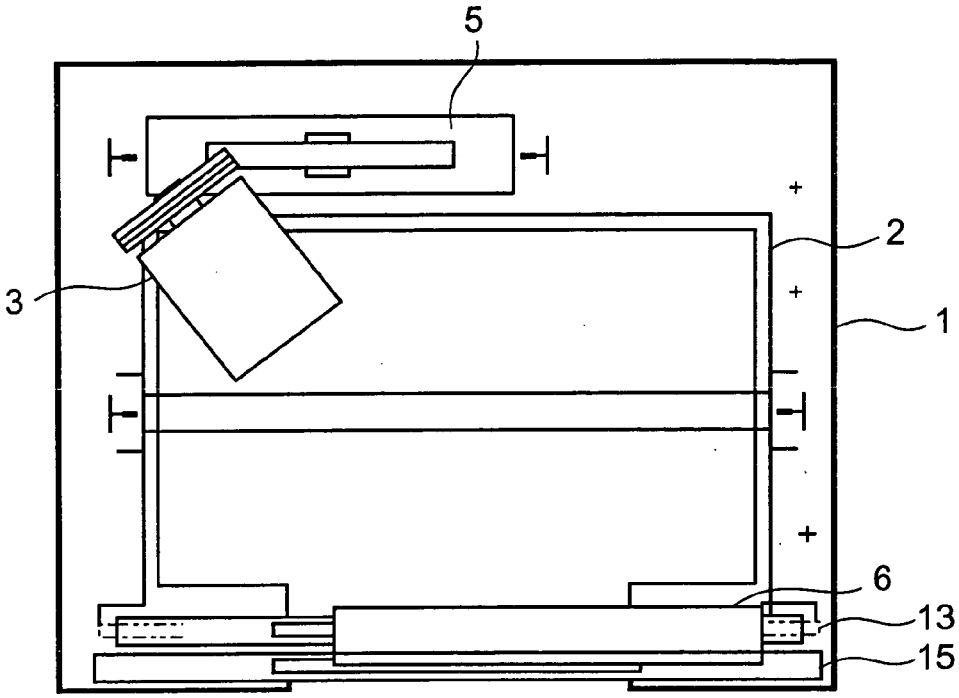
FIG. 4 is a plan view of the hoistway of relating to the second embodiment of the present invention as viewed from above the elevator hoistway.

FIG. 3 is a vertical sectional view of the top portion of the hoistway of an elevator system of an embodiment of the present invention, and FIG. 4 is a plan view of the hoistway as viewed from the above of the elevator hoistway of FIG. 3. The reference number 17 is the top-most landing floor, 18 is the ceiling of the top portion of the hoistway, and 19 is the elevator car at the highest position in the hoistway 1.

In this elevator system, the control panel 6 is disposed within the hoistway and above the protrusions, such as the landing floor door mechanism 1 and the building structure member 16, that project from the face 18 into the hoistway, and above the landing floor sill 15, and has a thickness projecting into the hoistway at a position above the car door mechanism. It is to be noted that the elevator car 2 does not interfere with the control panel 6 because the latter is disposed above the highest position 19 of the elevator car 2 in the hoistway. Therefore, the thickness of the control panel 6 can be designed without being limited by the dimensions of the protrusions from the hoistway wall. Also, the amount of protrusion of the control panel into the hoistway above the car can be reduced by an amount corresponding to the dimension of the protrusions mentioned above, so that interference at the time of maintenance of the control panel by personnel on the top of the car can be alleviated. By making the protrusion extend above the door mechanism so no one steps on the door mechanism during maintenance, almost no obstacle to maintenance is generated. Also, the surface of the control panel is close to the maintenance area of the car, so that the maintenance of the control panel is easy.

INDUSTRIAL APPLICABILITY

According to the present invention, a control panel for controlling the movement of a vertical moving member is disposed within a hoistway and in an overlapping relationship with a vertically projected region of a protrusion of a building structural member or equipment attached to the building wall. Therefore, the so-called machine room is not necessary and the control panel can be installed without the fear of interfering with the vertical moving member traveling within the hoistway.

Also, the control panel is positioned above an opening in the hoistway wall that provides access to the hoistway. Since no vertically elongated elevator member is installed immediately at the opening portion, the control panel mounted above the opening does not interfere with the other structural and elevator system members, so that no difficulty is caused in maintaining the control panel.

Also, the control panel may be installed above the landing floor door mechanism, so that the control panel can be easily accessed and maintained by opening the landing floor door mechanism and stepping on the car top.

Further, the control panel may be disposed at a position above the highest position of the vertical moving member within the hoistway, so that the thickness of the control panel is not limited by the dimensions of the protrusions from the hoistway wall, and the amount of protrusion of the control panel above the car can correspond to the dimensions of other protrusions, so that interference at the time of maintenance by personnel on the car top can be alleviated. Moreover, the surface of the control panel is close to a maintenance area on the car, so that the maintenance of the control panel is easy.

What is claimed is:

1. An elevator system comprising:

a hoistway including a hoistway wall and a bottom portion, said hoistway wall including a face and a protrusion projecting from said face into the hoistway;

a vertical moving member ascending and descending within the hoistway along a direction generally parallel to said face and not interfered with by said protrusion, wherein said protrusion is at least one member selected from the group consisting of a landing floor door mechanism and a building structural member disposed within a range of movement of the vertical moving member; and a control panel for controlling movement of said vertical moving member, said control panel being disposed within the hoistway on said face, wherein an area of said control panel projected along the direction of movement of said vertical moving member overlaps an area produced by projection of said protrusion along the direction of movement of said vertical moving member, said face of said hoistway wall includes a plurality of openings arranged along the direction of movement of said vertical moving member for providing access to said vertical moving member, said protrusion projects into the hoistway from said face farther than said control panel projects into the hoistway from said face, and said control panel is located in the hoistway between two of the openings.

2. The elevator system as claimed in claim 1, wherein said protrusion is a landing floor door mechanism, the landing floor door mechanism opens and closes the opening, and said control panel is installed on said face above said landing floor door mechanism.

3. An elevator system comprising:

a hoistway including a hoistway wall and a bottom portion, said hoistway wall including a face and a landing floor sill resting within the hoistway and spaced apart from the face;

a vertical moving member ascending and descending within the hoistway along a direction generally parallel to said face and not interfered with by said landing floor sill; and a control panel for controlling movement of said vertical moving member, said control panel being disposed within the hoistway on said face, wherein an area of said control panel projected along the direction of movement of said vertical moving member overlaps an area produced by projection of said landing floor sill along the direction of movement of said vertical moving member.

4. The elevator system as claimed in claim 3, wherein said control panel is positioned above an opening in said face of said hoistway wall for providing access to said vertical moving member.

5. The elevator system as claimed in claim 4, including a landing floor door mechanism for opening and closing the opening, wherein said control panel is installed on said face above said landing floor door mechanism.

6. The elevator system as claimed in claim 3, wherein said control panel projects into the hoistway from said face at least as far as said landing floor sill, and said control panel is located in the hoistway above a highest position reached by said vertical moving member within the hoistway.

7. The elevator system as claimed in claim 6, wherein said control panel projects into the hoistway beyond the landing floor sill.

8. The elevator system as claimed in claim 3, wherein said face of said hoistway wall includes a plurality of openings arranged along the direction of movement of said vertical moving member for providing access to said vertical moving member, said landing floor sill resting in the hoistway farther from said face than said control panel projects into the hoistway from said face, and said control panel is located in the hoistway between two of the openings.

* * * * *